US006165065A

United States Patent [19]

Pasij

[11] Patent Number: 6,165,065

[45] Date of Patent: Dec. 26, 2000

[54] VENT ASSEMBLY FOR WINDOW/WINDOW WELL COVER

[76] Inventor: Peter Pasij, 725 Indiana St., Elmhurst, Ill. 60126

[21] Appl. No.: 09/496,453

[22] Filed: Feb. 2, 2000

[51] Int. Cl.[7] ..... E06B 7/02

[52] U.S. Cl. ..... 454/212; 454/358

[58] Field of Search ..... 454/199, 212, 454/217, 273, 358; 49/394, 399, 401, 402

[56] References Cited

U.S. PATENT DOCUMENTS 1,809,518 6/1931 Kubatzky ..... 454/212

1,836,852 12/1931 Kubatzky ..... 454/212

5,433,663 7/1995 Henningsson et al. ..... 454/358

*Primary Examiner*—Harold Joyce

*Attorney, Agent, or Firm*—Kajane McManus

[57] ABSTRACT

The vent assembly for a window or window well cover comprises a base within the confines of which and to which a wedge shaped vent structure is hingedly mounted to be movable from a closed position where a solid top of the vent structure rests against the base along the length thereof to an open position where the top is pivoted away from the base around the hinge exposing other open screened walls of the vent structure which allow for entry of air only therethrough when exposed so no debris or animals may enter the area between the window and the cover therefor.

10 Claims, 2 Drawing Sheets

VENT ASSEMBLY FOR WINDOW/WINDOW WELL COVER

BACKGROUND OF THE INVENTION

1. Field of the Invention

The present invention relates to a vent assembly for a window cover or window well cover. More particularly, the vent assembly provides means for allowing air to enter through the covered window without need for removal of the cover.

2. Prior Art

Heretofore, window well covers for covering the well within which a window below ground level is located to keep debris, animals, and rain out of the well, have been proposed. Further, a cover has been proposed for use in covering a vertically oriented window just above ground level (usually a basement window) from rain splash up, among other things, wherein the cover is engaged over the window opening.

Each type of cover is typically secured in place against removal or shifting through use of nails or screws, making any attempt at removal of the cover an arduous procedure which is typically only done when replacement is required.

Thus, to date, there has been no simple way to allow air passage through the cover.

SUMMARY OF THE INVENTION

Accordingly, there is a need for an assembly which can be incorporated into new or existing window/window well covers to allow for passage of air therethrough.

Further, there is a need to provide an actuator for the assembly which can be operated from a location interior of the cover.

These and other objects of the invention are met by the vent assembly of the present invention which includes a wedge shaped three dimensional vent including a solid outer or top surface and screened or (vented) inner surfaces which allow passage of air therethrough when exposed, with the solid outer surface seating against and over contiguous edge surface area of the cover in which the vent assembly is disposed when closed, and an actuator rod engaging an undersurface of the vent and extending interiorly therefrom for use in opening/closing the vent of the assembly from a position interior of the covered window.

DESCRIPTION OF THE PREFERRED EMBODIMENTS

Figure 1:
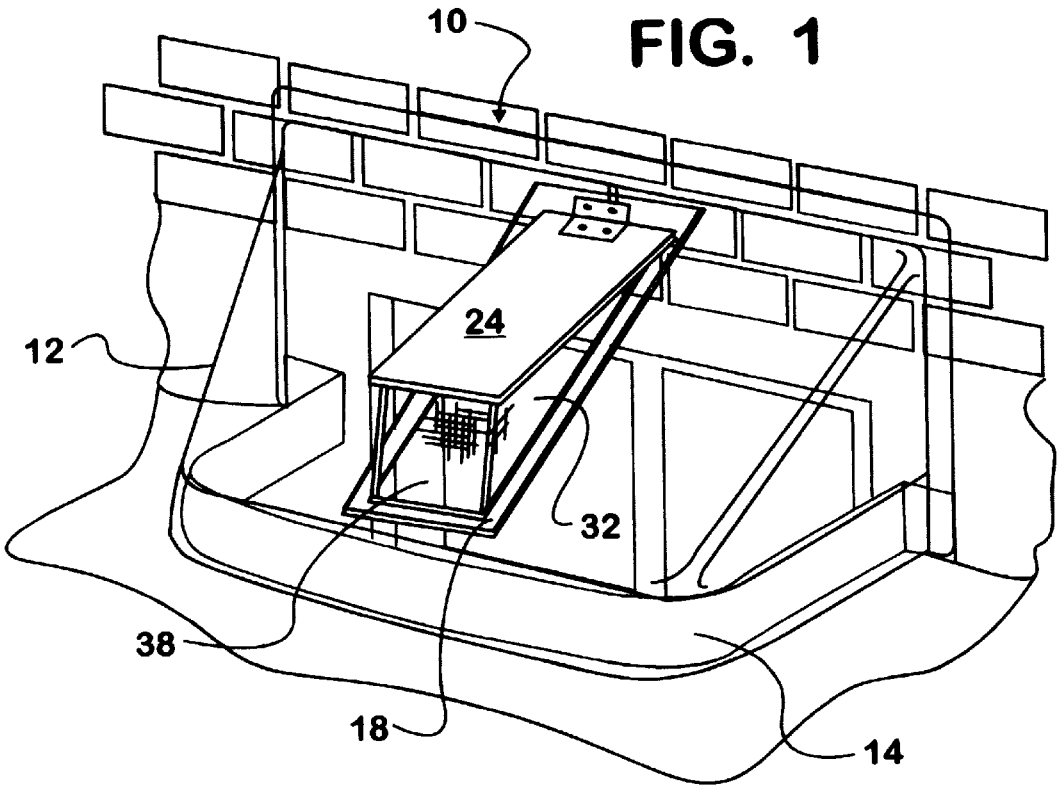
FIG. 1 is a perspective view of the vent assembly of the present invention incorporated into one embodiment of a window well cover.

Referring now to the drawings in greater detail, there is illustrated therein the vent assembly 10 made in accordance with the teachings of the present invention for use with a cover 12 for a window well 14 or a window 16.

As illustrated, the vent assembly 10 includes a base 18 having an opening 19 therein. A wedged shaped three dimensional vent structure 20 is fixed by a hinge 22 to the base 18 in a manner such that the vent structure 20 can pivot through the opening 19, within limits.

The vent structure 20 comprises a solid planar elongate rectangular top 24 to which one flap 26 of the hinge 22 is engaged, with a second flap 28 of the hinge 22 engaging the hinge 22 to the base 18.

From each elongate edge 30 of the top 24 depends a triangular side wall 32, a peak end 34 of which is subjacent the hinge 22. Extending between base ends 36 of each triangular side wall 32 is a base edge wall 38 which is substantially square in shape and engages a free swing edge 40 of the top 24.

The vent structure 20 is completed by a bottom wall 44 which engages the peak end 34 of the top 24 and extends angularly away therefrom to a point where it joins the base edge wall 38, with the top 24 and walls 32, 38 and 44 defining the wedge shaped vent structure 20.

It will be understood that the side walls 32, base edge wall 38 and bottom wall 44 are framed open structures, allowing for passage of air therethrough. To keep undesirable items, such as debris or small animals, etc., from entering into the area between the window 16 and the suitable cover 12 covering same, it is proposed that the side walls 32, the base edge wall 38 and the bottom wall 44 be covered by a mesh screening which will allow only passage of air therethrough.

The top 24, on the other hand, must be solid so that, in the event of rain, when the vent structure 20 is positioned to place the top wall 24 thereof directly against the underlying base 18, the rain will not enter the area between the cover 12 and the window 16.

To assure that rain or other forms of water do not enter the area between the cover 12 and the window 16, the top 24 is sized larger than the opening 19 in the base 18 through which the vent structure 20 pivots, and if desired, a rubber seal 50 can be positioned about and along the edge of the undersurface 52 of the top 24 to assure that nothing can move past when the top 24 is placed in a closed position thereof.

It will also be understood that there will be little, if any, clearance between the edges of the opening 19 in the base and any of the walls 32, 38 of the vent structure 20 contiguous thereto, to assure that no undesirable objects can move therepast into the area between the window 16 and the cover 12 thereover.

Still further, to ensure that the bottom wall 44 of the vent structure 20 does not pivot outwardly past the base 18, a suitable stop member, such as an end flange 54, is provided to keep the bottom wall 44 of the vent structure 20 from pivoting past the base 18.

It will be understood that the vent structure 20 can be pivoted between an open and closed position, as desired, from a position exterior to the cover 12. However, as a convenience, it is proposed to provide a suitable actuator 60 which can be used to adjust positioning of the vent structure 20 from a position interior to the window 16, particularly when adjusting position of the vent structure 20 engaged within a window well cover 12 which is typically difficult or impossible to reach from a position interior to the window 16 within the covered window well 14.

Figure 3:
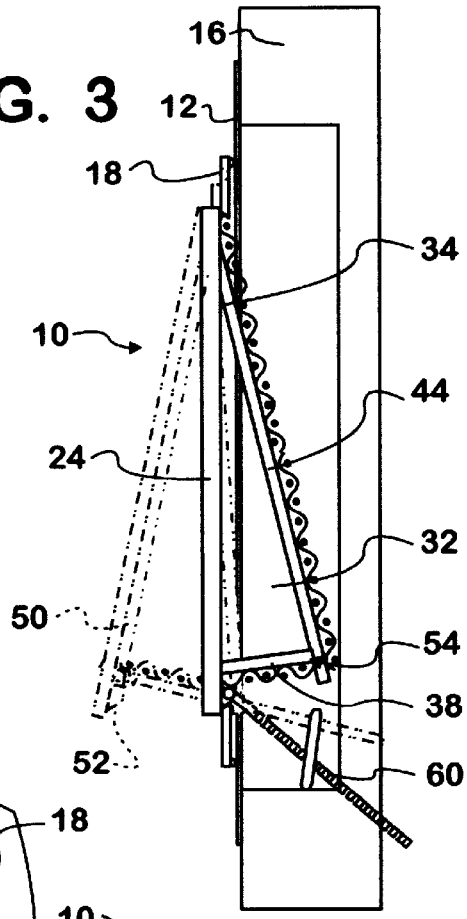
FIG. 3 is a side view through the vent assembly.

As best illustrated in FIG. 3, an actuating rod 60 may be engaged to the top 24 (oratany other suitable location) of the vent structure 20 which is reachable from a position inside the covered window and may be manipulated in any suitable fashion, one fashion of moving the vent structure 20 being illustrated in phantom in FIG. 3.

Figure 4:
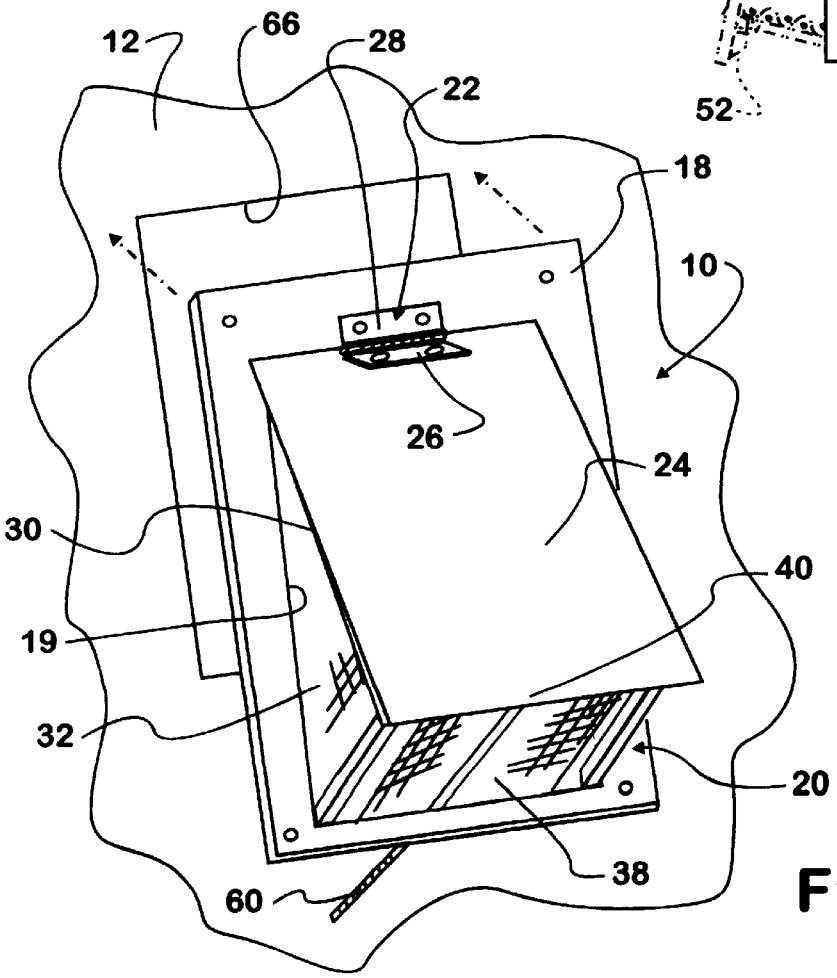
FIG. 4 is a perspective view of the vent assembly prior to installation into the cover.

Further, as illustrated in FIG. 4, the vent assembly 10 may be provided as an aftermarket add-on to existing nonvented covers, with an opening 66, being created in the cover 12 sized and configured to allow passage of the vent structure 20 therethrough but also configured and sized so that when the base 18 of the vent assembly 10 is fixed over the opening 66, and the top 24 of the vent structure 20 is in the closed position, nothing will enter the area between the window 16 and the cover 12 incorporating the vent assembly 10.

Figure 2:
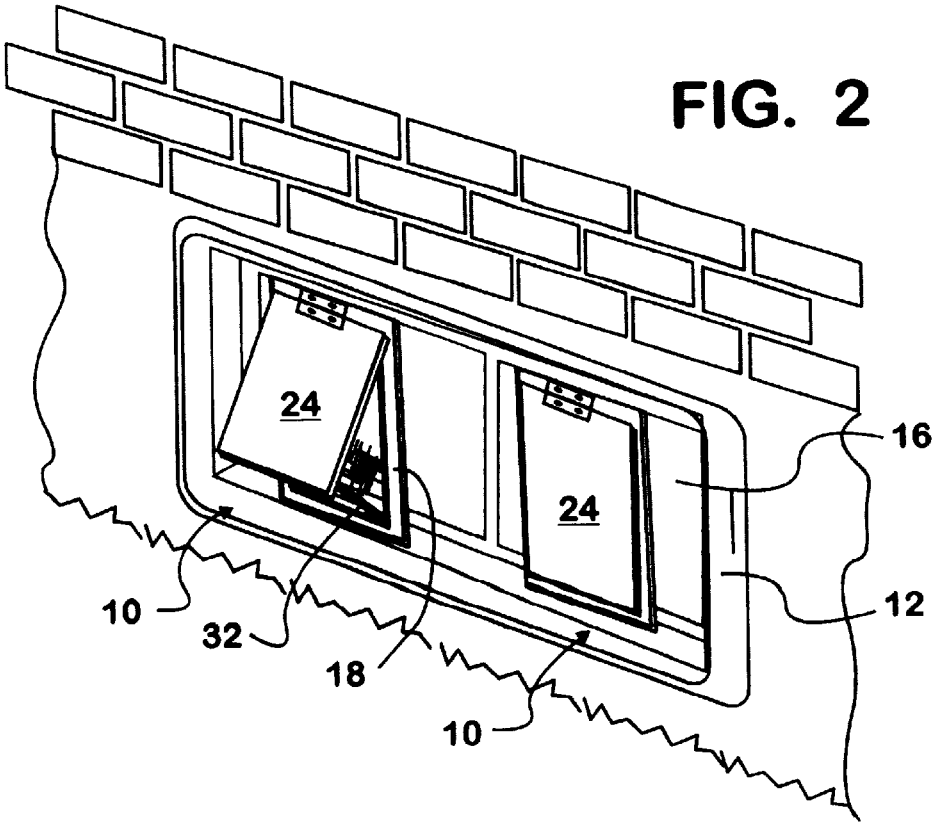
FIG. 2 is a perspective view of the vent assembly incorporated into a window cover.

As described above, the vent assembly 10 of the present invention provides a number of advantages, some of which have been described above and others of which are inherent in the invention. Also, modifications may be proposed to the vent assembly 10 without departing from the teachings herein. For example, multiple vent assemblies 10 may be incorporated into a single cover 12 if dimensions of the cover 12 so allow, as illustrated in FIG. 2. Also, a crank, or any other suitable type of known actuator may be provided for use in opening and closing the vent structure 20, or alternatively, no such actuator may be required or desired, as in the case of mounting the vent assembly 10 in a window cover 12. Accordingly, the scope of the invention is only to be limited as necessitated by the accompanying claims.

What is claimed is:

1. A vent assembly for a cover covering a window comprising a planar base having a center opening therein within and through which a wedge shaped vent structure pivots about a hinge engaging a peak of the wedge shaped vent structure to the base at a first end thereof, the vent structure having a solid top and open screened side, base and bottom walls which when the solid top is pivoted away from the base, allow air to enter an area interior to the window cover while keeping animals and debris out of the area interior to the cover.

2. The assembly of claim 1 wherein the cover is situated directly over a vertically oriented window.

3. The assembly of claim 1 wherein the cover is situated over a window well of a window below ground level.

4. The assembly of claim 1 wherein said vent structure comprises a wedge shaped member, having a solid top and screened side, end and bottom walls.

5. The assembly of claim 4 wherein said vent structure pivot through an opening in said base.

6. The assembly of claim 5 wherein said bottom wall includes a stop member for limiting pivoting of the vent structure relative to said base.

7. The assembly of claim 6 wherein said top wall has dimensions larger than the opening in said base to limit pivoting of the vent structure relative to said base.

8. The assembly of claim 7 wherein a rubber seal is positioned about a periphery of an undersurface of said top.

9. The assembly of claim 8 further including an actuator for pivoting said vent structure from a position interior to said cover.

10. The assembly of claim 9 wherein the seal lies flush against the base when the vent structure is in a closed position.

* * * * *